US007344169B2

(12) United States Patent
Han

(10) Patent No.: US 7,344,169 B2
(45) Date of Patent: Mar. 18, 2008

(54) STRIKER ASSEMBLY OF VEHICLE

(75) Inventor: Je-Sun Han, Jeonju-si (KR)

(73) Assignee: Hyundai Motor Company, Seoul (KR)

( * ) Notice: Subject to any disclaimer, the term of this patent is extended or adjusted under 35 U.S.C. 154(b) by 104 days.

(21) Appl. No.: 11/025,480

(22) Filed: Dec. 29, 2004

(65) Prior Publication Data

US 2005/0253401 A1 Nov. 17, 2005

(30) Foreign Application Priority Data

May 14, 2004 (KR) ..... 10-2004-0034306

(51) Int. Cl.
*E05B 15/02* (2006.01)

(52) U.S. Cl. ..... 292/340; 292/341.12; 292/341.13

(58) Field of Classification Search ..... 292/340, 292/216, DIG. 43, DIG. 42, DIG. 14, DIG. 72, 292/341.12, 341.13, 341.15
See application file for complete search history.

(56) References Cited

U.S. PATENT DOCUMENTS 2,508,090 A * 5/1950 Beems et al. ..... 292/129
3,442,543 A * 5/1969 Weyman ..... 292/340
4,961,601 A * 10/1990 Lindholm et al. ..... 292/216
5,035,455 A * 7/1991 Kurosaki ..... 292/341.17
5,431,460 A * 7/1995 Hass et al. ..... 292/216
5,785,365 A * 7/1998 Lorey ..... 292/216
6,257,632 B1 * 7/2001 Jung et al. ..... 292/341.18
6,474,705 B1 * 11/2002 Mori et al. ..... 292/216
2005/0077734 A1 * 4/2005 Lim ..... 292/216

* cited by examiner

*Primary Examiner*—Patricia Engle
*Assistant Examiner*—Kristina R Gluchowski
(74) *Attorney, Agent, or Firm*—Morgan Lewis & Bockius LLP

(57) ABSTRACT

A striker assembly of a vehicle is mounted with a coil part of a torsion spring at one column of the striker, thereby forming a simple and compact appearance of the striker, exerting a pop-up function within the simple structure, and enabling to reduce the weight, raw material and improve the appearance of the trunk room.

3 Claims, 2 Drawing Sheets

STRIKER ASSEMBLY OF VEHICLE

CROSS-REFERENCE TO RELATED APPLICATIONS

The present application is based on, and claims priority from, Korean Application Serial Number 10-2004-0034306, filed on May 14, 2004, the disclosure of which is hereby incorporated by reference herein in its entirety.

FIELD OF THE INVENTION

The present invention relates to a striker assembly of a vehicle. More particularly, the present invention relates to a pop up function that automatically distances a companion of a striker (e.g., a latch assembly installed at a trunk lid, or the like) from the striker when the striker is released from a hooked state.

BACKGROUND OF THE INVENTION

Generally, a latch assembly is installed at a trunk lid of a vehicle while a striker assembly is installed at a vehicle body. When the trunk lid is closed, the latch assembly hooks with the striker of the striker assembly. If the user releases the hooked state of the latch assembly, the latch assembly affixed to the trunk lid should be separated from the vehicle body for a predetermined gap and the released state of the latch assembly and striker should be continuously maintained. Thus, the striker assembly or vehicle body is equipped with a pop-up device to pop up the trunk lid.

The pop-up device releases the hooked state of the latch assembly and striker and provides an initial driving force to allow the trunk lid to automatically be opened, according to the type of vehicle.

SUMMARY OF THE INVENTION

Embodiments of the present invention are provided to simplify and compact the structure of a striker assembly, and to provide a pop-up function within the simplified structure.

A striker assembly of a vehicle comprises a base plate and a striker secured at the base plate. A torsion spring includes a coil part that is wound around one column of the striker. One end of the torsion spring is secured to the base plate, and the other end of the torsion spring is configured to be restricted in pivot range relative to the base plate. The torsion spring is positioned on the striker assembly such that, when a latch assembly hooks onto the striker assembly, the torsion spring stores elastic energy from being compressed. When the striker assembly is released from the hooked state, the torsion spring's elastic energy causes the latch assembly, and the trunk lid in turn, to pop up.

BRIEF DESCRIPTION OF THE DRAWINGS

For a better understanding of the nature and objects of the present invention, reference should be made to the following detailed description with the accompanying drawings, in which.

DETAILED DESCRIPTION OF THE PREFERRED EMBODIMENTS

Figure 1:
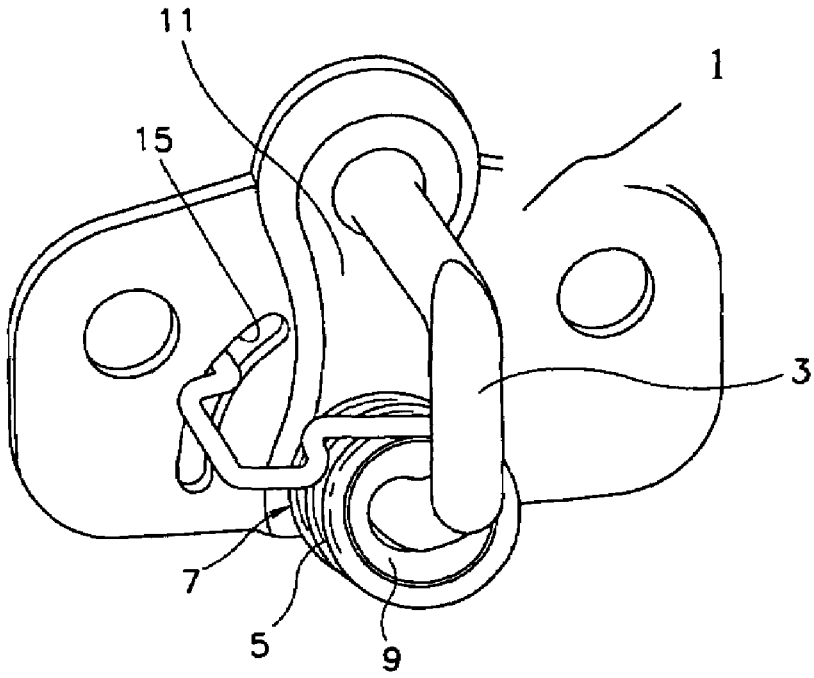
FIG. 1 is a perspective view of a striker assembly of a vehicle according to an embodiment of the present invention.
Figure 2:
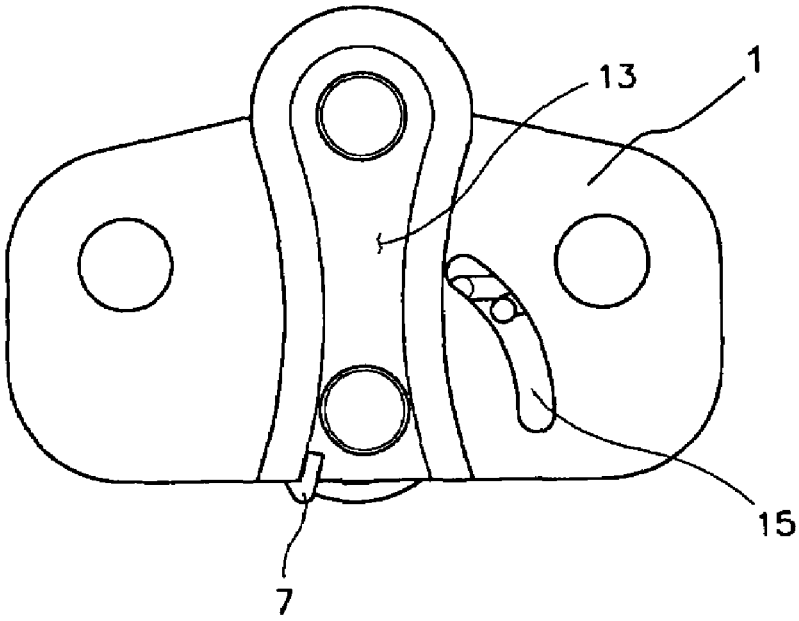
FIG. 2 depicts the rear of the striker assembly of FIG. 1.

Referring first to FIG. 1, a base plate 1 is installed with a striker 3 protruding out from the base plate 1. The striker 3 has a first column and a second column that are secured to the base plate 1. A coil part 5 of a torsion spring 7 is wound around a first column of the striker 3. One end of the torsion spring 7 is fixed to the base plate 1 while the other end is configured to be restricted in pivot range relative to the base plate 1.

A bushing 9 is mounted between the first column of the striker 3 and the coil part 5 of the torsion spring 7. The bushing 9 firmly fixes the coil part 5 of the torsion spring 7 to the first column of the striker 3 and prevents direct contact of the striker 3 to the torsion spring 7 during the operation of the torsion spring 7, thus avoiding the generation of noise.

The base plate 1 includes a protrusion 11 formed by bending the middle of the base plate 1 to protrude out along the protruded direction of the striker 3. A depression 13 is formed at the rear of the protrusion 11. The depression 13 allows the base plate 1 to feasibly be fixed to the vehicle body by preventing the striker 3 from protruding from the rear side of the base plate 1. The depression 13 is also affixed with one end of the torsion spring 7.

A first end of the torsion spring 7 is bent to be affixed to the depression 13 of the base plate 1. The first end of the torsion spring 7 affixed to the depression 13 does not protrude from the rear of the base plate 1, thus the base plate 1 can easily be fixed to the vehicle body. A second end of the torsion spring 7 is bent to perpendicularly penetrate the base plate 1. The base plate 1 is formed with an arc-shaped guide groove 15 into which the second end of the torsion spring 7 is inserted and guided. The second end of the torsion spring 7 is appropriately bent to form a large amount of contact region with a latch assembly 19 installed at a trunk lid 17 (see FIG. 3), thereby preventing a concentrated load onto certain portions of the latch assembly 19 due to the torsion spring 7.

Figure 3:
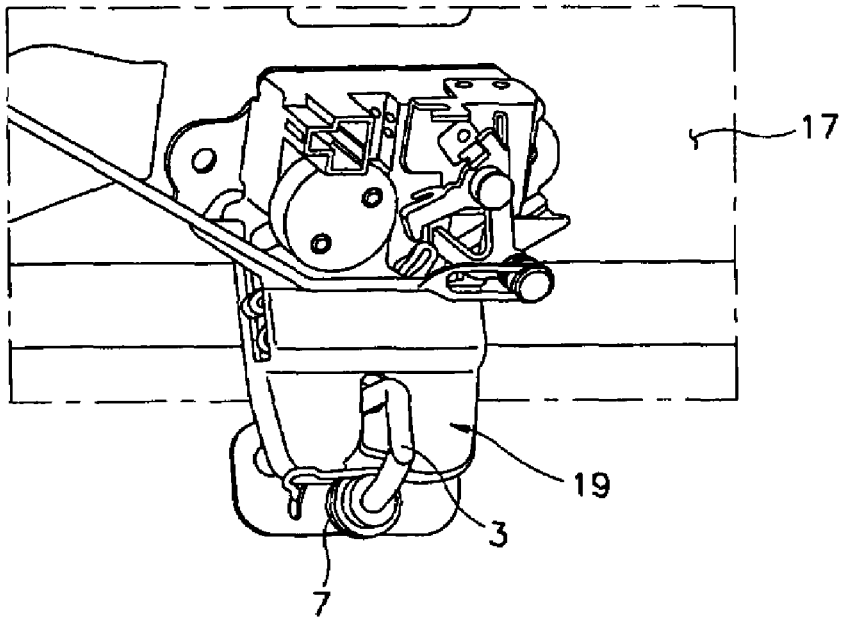
FIGS. 3 and 4 illustrate the operation of a striker assembly according to an embodiment of the present invention.

When the striker assembly thus constructed hooks onto the latch assembly 19 installed at the trunk lid 17 as shown in FIG. 3, the second end of the torsion spring 7 is pushed downward by the latch assembly 19 and the elastic energy is restored in the torsion spring 7. Once the latch assembly 19 hooks onto the second column of the striker 3, the latch assembly 19 is prevented from being distanced from the striker 3.

Figure 4:
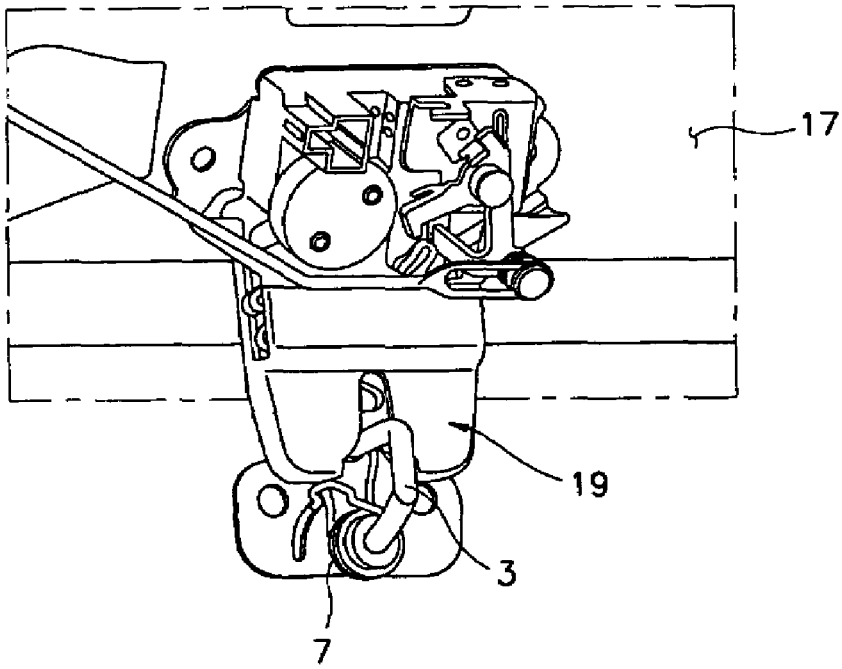

When the user releases the hooked state of the latch assembly 19, the latch assembly 19 pops up with the trunk lid 17 as illustrated in FIG. 4 due to the elastic energy restored in the torsion spring 7. The user can now either open or close the trunk lid from the popped-up state.

As apparent from the foregoing, there is an advantage in that the structure of the striker is simplified and compacted, and a pop-up function is provided under the simple structure, contributing to a reduction of weight, raw material, and improvement of the appearance of the trunk room.

What is claimed is:

1. A striker assembly of a vehicle, comprising:

a base plate comprising an arc-shaped guide groove;

a substantially U-shaped striker comprising a first and a second column, wherein a first end of each column is secured at said base plate, and a second end of each column is connected to a central striker portion; and a torsion spring comprising a coil part and first and second ends, wherein the coil part is wound around the first column of said striker, the first end of said torsion spring is secured to said base plate, and the second end of said torsion spring is biased in a direction from the first column to the second column, restricted in a pivot range thereof by said base plate, and inserted into and guided within the guide groove.

2. The assembly in claim 1, further comprising: a bushing mounted between said first column of said striker and said coil part of said torsion spring.

3. The assembly in claim 1, wherein said base plate further comprises:

a protrusion formed by bending a middle of said base plate to protrude out along a protruded direction of said striker; and a depression formed at a rear of said protrusion, and wherein the first end of said torsion spring is fixed to said depression.

* * * * *